US005720661A

United States Patent [19]

Yoshizawa et al.

[11] Patent Number: 5,720,661

[45] Date of Patent: Feb. 24, 1998

[54] INVERSION TYPE VENTILATING FAN

[75] Inventors: Kiyoshi Yoshizawa; Hajime Okazaki, both of Tokyo, Japan

[73] Assignees: Marix Co., Ltd.; Seiwa Precision Ind. Ltd., both of Tokyo, Japan

[21] Appl. No.: 607,855

[22] Filed: Feb. 27, 1996

[51] Int. Cl.[6] ..... F24F 7/06

[52] U.S. Cl. ..... 454/341; 415/60; 454/345; 454/354

[58] Field of Search ..... 454/341, 345, 454/346, 354, 350, 351, 353; 415/60, 122.1, 124.1, 61

[56] References Cited

U.S. PATENT DOCUMENTS

| | | | |
|---|---|---|---|
| 1,734,449 | 11/1929 | Smith | 454/345 |
| 2,082,955 | 6/1937 | Hagen | 454/341 X |
| 2,828,682 | 4/1958 | Marker | 454/354 |

FOREIGN PATENT DOCUMENTS

| | | | |
|---|---|---|---|
| 3-36437 | 3/1991 | Japan | 454/345 |
| 3-67942 | 3/1991 | Japan | 454/345 |
| 4-143539 | 5/1992 | Japan . | |

*Primary Examiner*—Harold Joyce
*Attorney, Agent, or Firm*—Armstrong,Westerman,Hattori,McLeland & Naughton

[57] ABSTRACT

The ventilating fan system comprises an air flow passage including a duct for guiding the air in a room to outside and a ventilating fan arranged in the air flow passage; whereby said ventilating fan is an inversion type ventilating fan, in which opposed rotating blades arranged in a direction perpendicular to flowing direction of the air are rotated in reverse directions, and the ventilating fan is arranged at an end portion of the air flow passage closer to outside and sucks the air in the room and discharges it to outside.

6 Claims, 4 Drawing Sheets

INVERSION TYPE VENTILATING FAN

BACKGROUND OF THE INVENTION

The present invention relates to a ventilation fan system used for air ventilation in rooms of buildings such as collective housing, and in particular to a suction type ventilating fan system equipped with a ventilating fan, which is provided with rotating blades mounted at opposed positions and rotated in reverse directions.

In the past, a ventilating fan system used for air ventilation of rooms in buildings has been known.

(a) Such a ventilating fan system comprises an air flow passage including a duct for guiding the air inside the room to outside and a ventilating fan arranged at an end portion of the air flow passage closer to the space inside the room and for ventilating the air by means of a rotating fan.

(b) One of the present inventors has developed a ventilating fan system consisting of a ventilating fan, which comprises a fan main unit in form of a disk, openings arranged on the fan main unit, and blades for covering the openings so that the air passes therethrough, whereby said ventilating fan is arranged at an end portion of the air flow passage closer to outside. A patent application for this ventilating fan system has been already filed by the inventor.

In the ventilating fan system as described in (a) above, the ventilating fan is arranged at an end portion of the air flow passage closer to the room, and a problem arises that noise of a motor for rotating the fan causes nuisance in the room. Also, the ventilating fan is designed in push-out type for forcibly sending and compressing the air into a duct from back portion and discharging the air. As a result, unless air quantity matching the ventilating ability of the rotating fan and motor output is discharged from the end portion of the air flow passage closer to outside, the air quantity is decreased by air resistance on inner surface of the duct from the original air quantity energy, and it is converted to noise energy to vibrate the duct and the associated parts. Moreover, pulsation occurs in the air, and this is turned to resistance. For this reason, the predetermined or desired air quantity cannot be obtained. This resulted in the problems such as the need to increase duct diameter or to eliminate the trouble caused by noise.

In the ventilating fan system described in (b) above, a single fan is used and the rotating fan is designed in form of a disk. As a result, the system lacks pressure energy to push the air forward, and the desired air quantity cannot be obtained. Thus, the system is not suitable for industrial applications.

In the past, the ventilating fan designed in suction type ventilating fan system has not been used in industrial applications.

SUMMARY OF THE INVENTION

It is an object of the present invention to provide a ventilating fan system, by which, under load conditions connected with ducts and others, the desired air quantity matching the load can be reliably obtained as a suction type ventilating fan.

It is another object of the present invention to provide a ventilating fan system, in which opposed rotating blades can be rotated in reverse directions at the same speed by a single motor and ventilating capacity is not decreased as the motor and the swirling air flow does not hinder the air ventilation.

It is still another object of the present invention to provide a ventilating fan system, which is designed in suction type and by which it is possible to reduce noise compared with the conventional system and to make the duct diameter much smaller.

To attain the above objects, the ventilating fan system of the present invention comprises an air flow passage including a duct for guiding the air inside a room toward outside and a ventilating fan arranged in the air flow passage;

whereby said ventilating fan comprises an inversion type ventilating fan, in which rotating blades mounted at opposed positions and arranged in a direction perpendicular to the flowing direction of the air are rotated in reverse directions, the ventilating fan is arranged at an end portion of the air flow passage closer to outside, and the air in the room is sucked and is discharged to the outside.

The desired air quantity can be obtained as the suction type ventilating fan by rotating the opposed rotating blades in reverse directions. This is because the flow of the air provided with swirling energy by one of the rotating blades is straightened to a flow in axial direction by the other of the rotating blades. Thus, the swirling energy is converted to pressure energy, and the forward moving force is provided.

An inversion type axial flow ventilating fan having opposed rotating blades rotated in reverse directions has been known in the past.

In this system, however, each of the opposed rotating blades is rotated by a different motor, and two motors are required. As a result, ventilating capacity is decreased because the motors hinder air ventilation, and there is also the problem of higher cost.

Moreover, the spacing between the blades is large in the inversion type ventilating fan, and the area of the blade is relatively small. Thus, even when this is turned to a suction type ventilating fan, the desired air quantity cannot be obtained and the system cannot be used for industrial applications.

The present inventors have found that the opposed rotating blades can be rotated in reverse directions by means of a single motor when a planetary gear unit is adopted because a shaft of a sun gear and an outer unit internal gear are rotated in opposite directions in the planetary gear unit. However, in case the planetary gear unit is adopted with no additional change, the number of revolutions of the shaft of the sun gear is different from that of the internal gear of the outer unit. As a result, the opposed rotating blades are rotated at different speeds.

To obtain the desired air quantity as a ventilating fan system, it is preferable that the opposed rotating blades are rotated at the same speed in opposite directions. When the blades are rotated in opposite directions at different speeds, the swirling air flow cannot be sufficiently straightened, and it is not possible to completely convert the swirling energy to pressure energy in a linear direction.

To rotate the opposed rotating blades in opposite directions at the same speed, it should be designed in such manner that two planetary gear units having the same speed reduction ratio are connected to the system, using one of the planetary gear units as a speed increaser and the other as a speed reducer. In so doing, input shaft and output shaft are rotated in opposite directions at the same speed, and the rotating blades fixed on the input shaft and the output shaft respectively can be rotated in opposite directions at the same speed.

More concretely, the inversion type ventilating fan can be designed in such manner that sun gear shafts of two planetary gear units arranged on the same shaft in opposite directions are connected with each other, and a carrier disk of one of said planetary gear units is made freely movable, and a carrier disk of the other planetary gear unit is fixed. The internal gear of the outer unit of the planetary gear unit having the freely movable carrier disk is fixed, and an internal gear of the outer unit of the other planetary gear unit is made freely movable. On a member connected to the carrier disk of said one of the planetary gear units, one of the rotating blades is fixed, and the other of the rotating blades is fixed on the freely movable internal gear of the outer unit or on the member connected to said internal gear of the outer unit.

The above and other objects and advantages of the invention will become more apparent from the following description.

DETAILED DESCRIPTION OF THE PREFERRED EMBODIMENT

In the following, description will be given on an embodiment of the present invention referring to the attached drawings.

Figure 1:
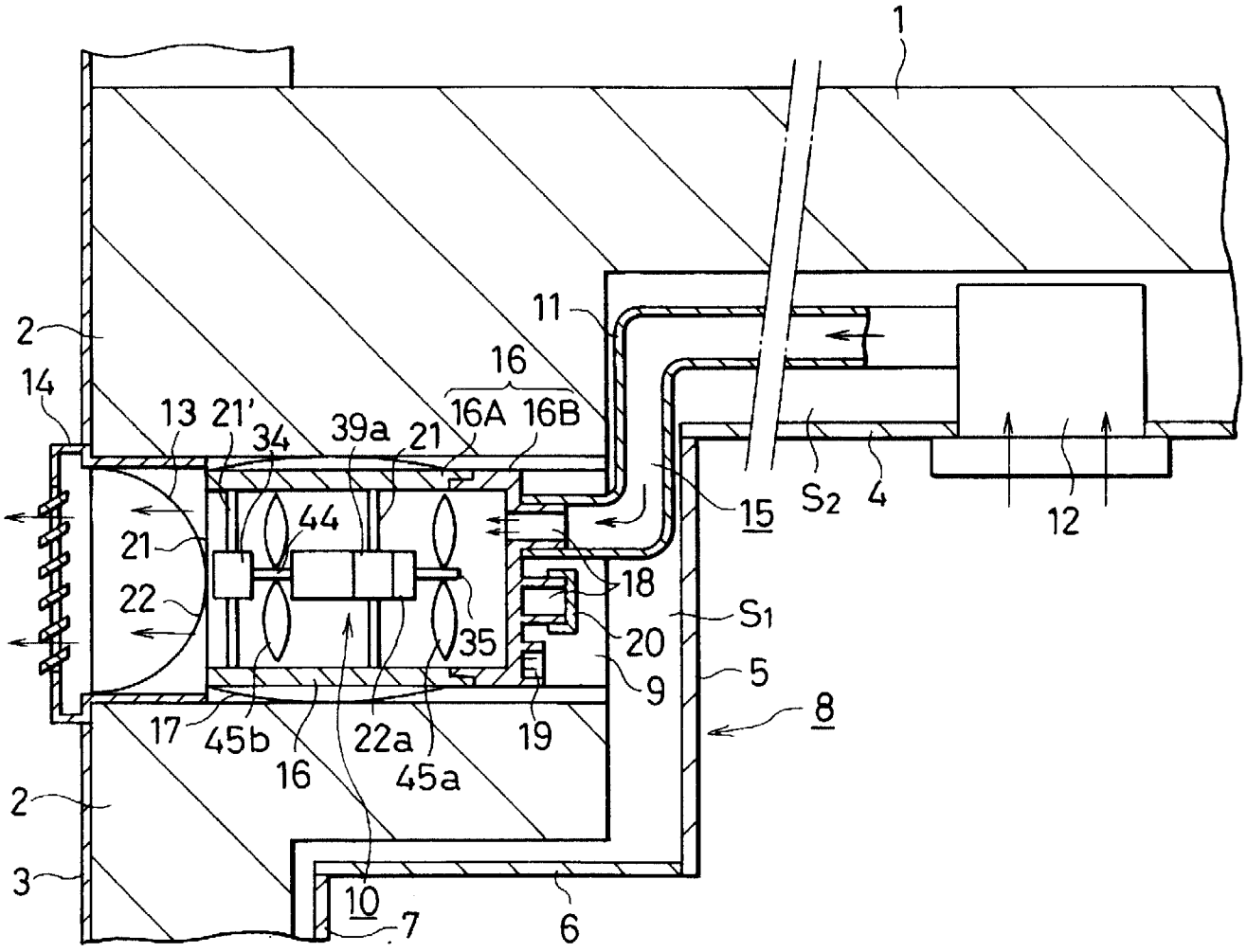
FIG. 1 is a longitudinal sectional view of an embodiment of the present invention.

FIG. 1 is a longitudinal sectional view showing an essential part of a building where a ventilating fan system of the embodiment of the present invention is applied. This building is a collective housing built by concrete placing. A wall 3 of a lower floor room is positioned below a floor 1 of an upper floor room, and the wall 3 constitutes an outer wall of the housing. A ceiling surface member 4 is arranged under the floor 1, and inner surface materials 4 to 7 are arranged on inner sides of a projected portion 2 and the wall 3. A beam member 8 protruding into the lower floor room is defined by the projected portion 2 and the room inner surface materials 5 and 6.

On the projected portion 2, a through-hole 9 penetrating the projected portion 2 in horizontal direction is formed, and a ventilating fan 10 is incorporated in the through-hole 9. To the ventilating fan 10, one end of a duct 11 made of a flexible material is connected, and the duct is installed in a space $S_1$ between the projected portion 2 and the room inner surface member 5 and in a space $S_2$ between the floor 1 and the ceiling surface member 4. To the other end of the duct 11, a ventilating grill 12 contiguous to the lower floor room via the ceiling surface member 4 is connected.

On the forward portion (outside the room) of the ventilating fan 10 in the through-hole 9, a weather cover 14 equipped with a fire damper 13 is mounted. The ventilating fan 10 is covered by the weather cover 14 and is not exposed to outside. An air flow passage 15 for guiding the air in the room toward the outside is formed by the ventilating grill 12, the duct 11, the through-hole 9, and the weather cover 14, and the ventilating fan 10 is positioned at an end portion (closer to outside) of the air flow passage 15. The room contiguous to the ventilating grill 12 may be living room, toilet room, kitchen room, bathroom, etc.

The ventilating fan 10 is fixed on a casing 16 by rod-like brackets 21, which are connected with a housing main unit 39*a* of the ventilating fan in vertical and horizontal directions and are fastened to inner surface of the through-hole 9 by a fastening member 17 in form of a plate spring and arranged on the casing 16.

The casing 16 is divided into front and back portions, i.e. a front portion 16A freely connectable and separable and a rear portion 16B. On the rear portion 16B, joints 18 for connecting the duct 11 and a socket 19 for connecting electrical cord are arranged so that the duct 11 can be connected with the rear portion 16B separated from the front portion 16A.

There are two or more joints 18, and a plurality of ducts 11 can be connected to a single ventilating fan 10. In the figure, only one duct 11 is connected, and the other joints 18 with no duct connected are blocked by a lid 20.

The forward ends of rotating shafts 35 and 44, on which rotating blades 45*a* and 45*b* of the ventilating fan 10 are mounted, are connected to a rotating shaft of a motor 34, and the motor 34 is fixed on the casing 16 by a bracket 21' in the same manner as the ventilating fan 10. The motor 34 may be connected to the rear end of the rotating shaft 44.

Figure 4:
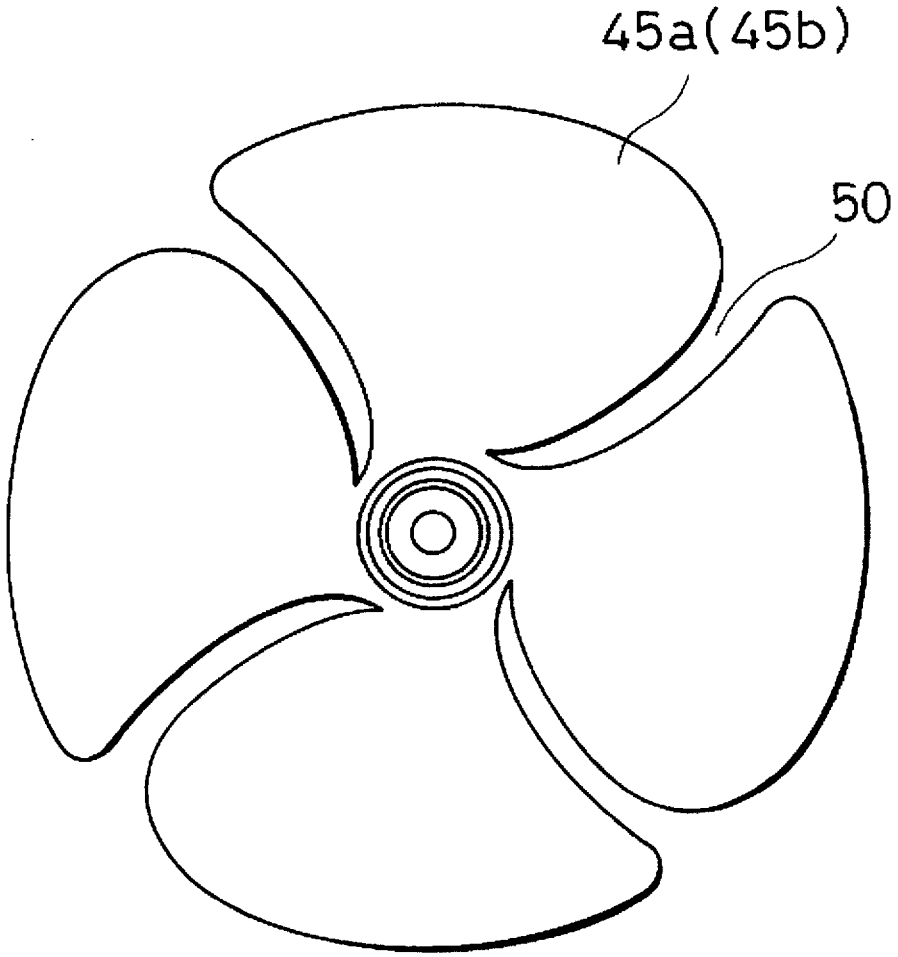
FIG. 4 is a front view of a rotating blade used in the present invention.

As shown in FIG. 4, the rotating blades 45*a* and 45*b* are designed in such manner that the spacing between the adjacent blades is reduced and total area of the blades is increased. Also, the forward ends of the rotating blades 45*a* and 45*b* are positioned closer to the inner surface of the air flow passage (through-hole 9) 15 via the casing 16. As a result, effective air quantity can be obtained as a suction type ventilating fan.

The forward ends of the rotating blades 45*a* and 45*b* can be positioned directly closer to the air flow passage. It is preferable that the rotating blades are positioned as close to the inner surface as possible so far as they do not hit the surface. The contiguous portions of the adjacent blades may be bent so that there is no spacing in rotating direction but there is some spacing in front-back direction to increase surface area of the blades.

Figure 2:
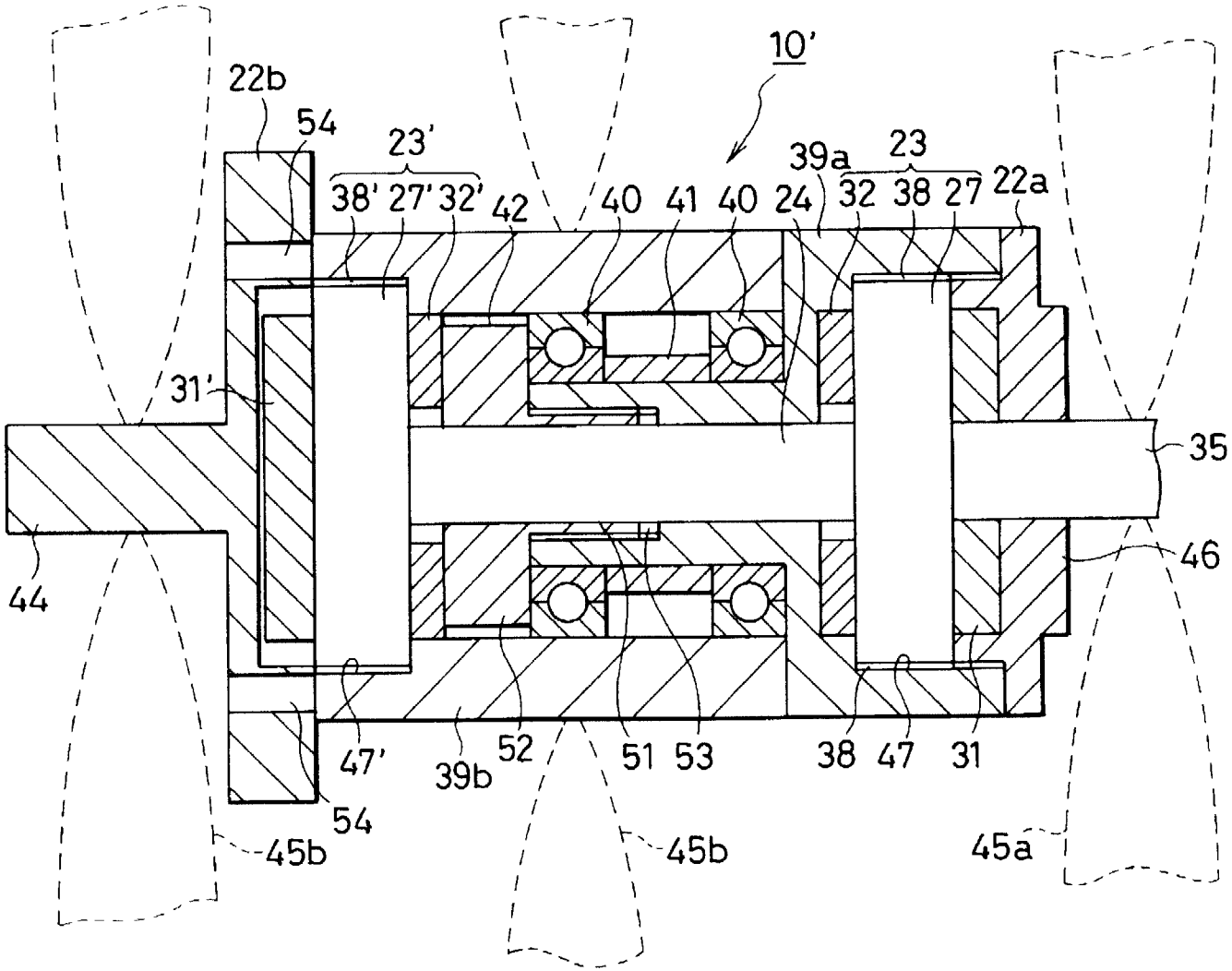
FIG. 2 is a cross-sectional view of a ventilating fan used in the present invention.
Figure 3:
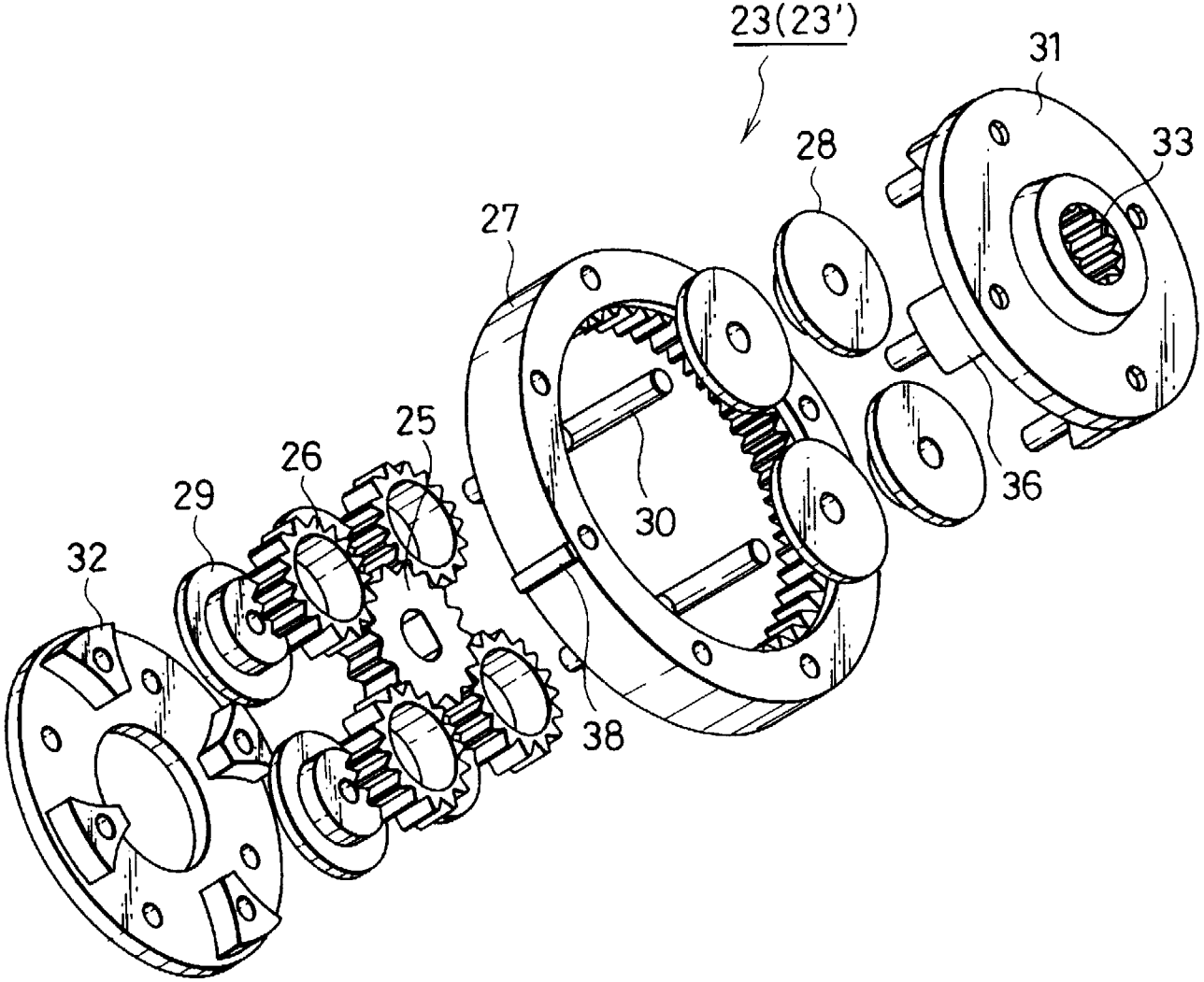
FIG. 3 is an exploded perspective view of a planetary gear used in the present invention.

The inversion type ventilating fan system 10' as described in the above embodiment has an arrangement as shown in FIG. 2 and FIG. 3. Internal gears 27 and 27' of an outer unit are not shown in cross-sectional view of FIG.

As shown in FIG. 2, planetary gear units 23 and 23' are connected in such manner that the output shaft of the planetary gear unit 23 serves as the input shaft of the planetary gear unit 23' by means of a rotating shaft 24.

As shown in FIG. 3, each of the planetary gear units 23 and 23' comprises a sun gear 25 at the center, four planetary gears 26 engaged with and encircling the sun gear 25, and an outer unit internal gear 27, which engages with all of the planetary gears 26.

Each of the planetary gears 26 is rotatably squeezed by planetary disks 28 and 29, and planetary shafts 30 are passed through the planetary disks 28 and 29. Both ends of the planetary shaft 30 are engaged with and fixed on carrier disks 31 and 32.

In the central hole 33 of the carrier disk 31, an input shaft (rotating shaft) connected with the rotating shaft of the motor 34 is screwed and engaged, and a sun shaft 36 at the center on the lower surface of the carrier disk 31 engaged with and fixed on the sun gear 25 is connected to and fixed on the rotating shaft 24, which serves as the input shaft of the other planetary gear unit 23'. The sun shaft 36 is integrated with the carrier disk 31, while it may be provided as a separate unit and fixed on the carrier disk.

Turn-stop projections 38 are arranged on outer periphery of the outer unit internal gear 27 on opposite sides of the periphery.

As shown in FIG. 2, the carrier disk 31 of the planetary gear unit 23 is rotatably provided with a cover 22*a*, and an input shaft 35 is rotatably supported in a hole at the center of the cover 22*a*.

The housing main unit 39*a* of the ventilating fan comprises a small diameter cylinder body where the rotating shaft 24 is rotatably engaged with and a large diameter cylinder body where the planetary gear unit 23 is engaged, and it is engaged with and mounted on each of the projections 38 of the outer unit internal gear 27 via an engaging hole 47 formed on inner periphery of the large diameter cylinder body. The housing main unit 39*a* is connected with and fixed on the cover 22*a*.

With the arrangement as described above, even when the input shaft (carrier shaft) 35 is being rotated, the sun shaft 36 can be rotated without rotating the outer unit internal gear 27. As a result, the planetary gear unit 23 serves as a speed increaser.

On outer periphery of the small diameter cylinder body of the housing main unit 39*a*, two bearings 40 and 40' are mounted at opposed positions via collars 41.

Between the rear portion of the housing main unit 39*a* and the carrier disk 32' of the other planetary gear unit 23', a gear fixing member 42 having a through-hole at the center is arranged.

The gear fixing member 42 is rotatably engaged with and supports the rotating shaft 24 via the through-hole at the center.

The gear fixing member 42 comprises a small diameter cylinder body 51 screwed in and engaged with inner periphery of the small diameter cylinder body of the housing main unit 39*a* and a large diameter cylinder body 52 kept in contact with and connected to the carrier disk 32' of the planetary gear unit 23'. The gear fixing member 42 is connected to and fixed on the carrier disk 32' by bolt.

On outer periphery of the bearings 40 and 40' and the planetary gear unit 23', a housing main unit 39*b* in cylindrical shape of the ventilating fan is rotatably engaged. The housing main unit 39*b* is engaged with and mounted on a projection 38' of an outer unit internal gear 27' via an engaging hole 47' formed on its inner periphery.

When the rotating shaft 24 connected with the sun shaft 36 is rotated, the outer unit internal gear 27' of the planetary gear unit 23' is rotated, together with the housing main unit 39*b*, in a direction reverse to the rotation of the rotating shaft 24.

On the carrier disk 31' of the planetary gear unit 23', a cover 22*b* having a rotating shaft 44 at the center is loosely engaged, and the cover 22*b* is fixed on the housing main unit 39*b* with a bolt (not shown) inserted through a through-hole 54. Thus, the rotating shaft 44 is rotated, together with the cover 22*b* and the housing main unit 39*b*, in a direction reverse to the rotation of the rotating shaft 24.

When a rotating blade 45*a* is fixed on the input shaft 35, a rotating blade 45*b* fixed on the rotating shaft 44 is rotated in a direction reverse to the rotating direction of the rotating blade 45*a* at the same speed.

The rotating blade 45*b* may be fixed on outer periphery of the housing main unit 39*b*. In such case, a cylinder body having the same diameter as that of the housing main unit 39*b* may be fixed on the rotating shaft 35 and the rotating blade 45*a* may be fixed on this cylinder body. The cylinder body may be rotatably engaged with a projection 46 of the cover 22*a*.

Any type of planetary gear unit may be used as the planetary gear units 23 and 23' of the present invention so far as it comprises a sun gear 25, planetary gears 26, an outer unit internal gear 27, and carrier disks 31 and 32.

It is preferable that the planetary gear units 23 and 23' have the same speed reduction ratio. Using the planetary gear units having the same speed reduction ratio and employing one of them as a speed increaser and the other as a speed reducer, the rotating blades can be rotated at the same speed and in reverse directions.

To rotate the rotating blades 45*a* and 45*b* at the same speed and in reverse directions, any type of arrangement can be adopted so far as the outer unit internal gear 27 of the planetary gear unit 23 where the input shaft is connected as well as the carrier disk 32' of the other planetary gear unit 23 are fixed and the input shaft 35 of the planetary gear unit 23 as well as carrier disks 31 and and 32 and the outer unit internal gear 27' of the planetary gear unit 23' can be rotated. The carrier disks 32' and 31' as well as 32 and 31 of the same planetary gear unit are designed in such manner that, if one of them is fixed, the other is also fixed, and if one of them is rotated, the other is also rotated.

In the above embodiment, a single rotating blade is mounted on the rotating shafts 35 and 24, while there may be two or more rotating blades. This is because swirling flow of the air sucked by a plurality of rotating blades can be straightened by the other plurality of rotating blades, and the flow is converted to linear flow.

In the above embodiment, the sun shaft of one planetary gear unit 23 and the sun shaft of the other planetary gear unit 23' are connected by the rotating shaft 24, while the rotating shaft 24 may be integrated with the sun shaft of the other planetary gear unit. The rotating shaft 24 may be integrated with the sun shafts of the two planetary gear units, while it is difficult to assemble when integrated.

In the above embodiment, two planetary gear units are connected, while a system where there opposed rotating blades are rotated in reverse directions at the same speed can be designed if the rotating shaft 44 of FIG. 2 is used as the input shaft 35, and the planetary gear units 23 and 23' are connected in the same manner. By connecting the planetary gear units one after another, a system can be designed where a number of rotating blades can be rotated in directions reverse to each other.

It is preferable that there are an even number of the rotating blades, which are rotated in directions reverse to each other. In case the planetary gear units are connected, it is preferable that there are an even number of the units as a whole. This is because the swirling flow and the straightened flow are repeatedly generated, and the last flow must be a straightened flow.

In the above embodiment, the planetary gear units having the same speed reduction ratio are used, using one of them as a speed increaser and the other as a speed reducer. As a result, the rotation from the input shaft is increased by one of the planetary gear units. The speed is reduced by the other planetary gear unit to the same extent as the increased speed, and the rotation at the same speed as the rotation from the input shaft can be achieved.

In FIG. 2, description is given on the case where the motor is connected to the input shaft 35. Even when the motor 34 is connected to the rotating shaft 44 as shown in FIG. 1, the rotating blades 45 and 45*b* are rotated in reverse directions. Namely, when the rotating shaft 44 is rotated by the motor 34, the cover 22*b*, the housing main unit 39*b* and the outer unit internal gear 27' are rotated together in the same direction. The sun shaft (not shown) of the outer unit internal gear 27' are rotated together with the sun shaft 36 of the planetary gear unit 23 in reverse direction, and the shaft 35 is rotated in a direction reverse to the rotation of the rotating shaft 44.

It is possible according to the present invention to provide a suction type ventilating fan system to reliably obtain the air quantity as desired because a ventilating fan having opposed rotating blades rotated in reverse directions is used, and swirling air flow by one of the rotating blades is straightened by the other rotating blade, thereby giving linear energy, i.e. forward moving force, to the air.

When a single motor is used, the system can be designed in compact form, and smooth air ventilation can be achieved because hindrance of air ventilation by a large motor can be avoided.

Also, it is possible according to the present invention to reduce the noise of the motor and of the swirling air in the room because the ventilating fan 10 is arranged at the end portion near outside, and the motor 3 of the ventilating fan 10 is arranged at a position relatively far from the space inside the room compared with the conventional case where the ventilating fan is arranged on the ventilating grill 12, which is located at an end portion of the air flow passage 15 closer to the space inside the room.

By arranging the ventilating fan 10 at an end portion of the air flow passage 15 closer to the space inside the room, the ventilating fan 10 is designed as suction type, and the desired air quantity as suction type can be obtained. For this reason, the air quantity based on the ventilating ability of the rotating blades and the motor output can be reliably discharged to outside. Therefore, unlike the conventional type ventilating fan system designed as push-in type, it is possible to reduce the ratio of the conversion of the original air quantity energy to noise energy, which vibrates the duct 11 and its components forming the air flow passage 15, and also to reliably obtain the desired air quantity, to increase ventilation efficiency and to reduce noise.

What is claimed is:

1. A suction type ventilating fan system, comprising an air flow passage including a duct for guiding the air inside a room to outside, a ventilating fan arranged in the air flow passage, whereby said ventilating fan is an inversion type ventilating fan where opposed rotating blades arranged in a direction perpendicular to the direction of the air flow are rotated in reverse directions, the rotating blades of the inversion type ventilating fan are designed in such a manner that spacing is provided in front-back direction with no spacing in the rotating direction to increase area of the blades, and outer periphery of the rotating blade is positioned closer to the inner periphery of the air flow passage either directly or via a casing, and a single motor for rotating the blades of the inversion type ventilating fan in reverse directions and at a same speed, said ventilating fan being arranged at an end portion of the air flow passage closer to outside, and the air in the room is sucked and discharged to outside by the fan.

2. A ventilating fan system according to claim 1, wherein an even number of opposed rotating blades are rotated in reverse directions in said inversion type ventilating fan.

3. A ventilating fan system according to claim 1, wherein sun shafts of planetary gear units arranged at opposed positions on the same shaft are connected with each other, a carrier disk of one of said planetary gear units is designed as freely movable, a carrier disk of the other planetary gear unit is fixed, an outer unit internal gear of the planetary gear unit of said freely movable carrier disk is fixed, an outer unit internal gear of the other planetary gear unit is designed as freely movable, one of the rotating blades is fixed on a member connected to the carrier disk of one of said planetary gear units, and the other of the rotating blades is fixed on the freely movable outer unit internal gear or to a member connected to said outer unit internal gear.

4. A ventilating fan system according to claim 3, wherein said opposed planetary gear units have the same speed reduction ratio, and said opposed rotating blades are rotated at the same rotating speed and in reverse directions.

5. A ventilating fan system according to claim 3, wherein said planetary gear unit comprises a sun gear, planetary gears, an outer unit internal gear and carrier disks.

6. A ventilating fan system according to claim 5, wherein a turn-stop projection is formed on outer periphery of said outer unit internal gear.

* * * * *